US005722681A

United States Patent [19]

Merino et al.

[11] Patent Number: 5,722,681

[45] Date of Patent: Mar. 3, 1998

[54] ALPINE SKI BINDING APPARATUS

[75] Inventors: Jean-Francois Merino, Annecy Le Vieux; Pierre Desarmaux, Evires; Pascal Thomas, Chambery, all of France

[73] Assignee: Salomon S.A., Metz-Tessy, France

[21] Appl. No.: 501,865

[22] Filed: Jul. 13, 1995

[30] Foreign Application Priority Data

Jul. 13, 1994 [FR] France ..... 94 08940

[51] Int. Cl.[6] ..... A63C 9/08

[52] U.S. Cl. ..... 280/634; 280/636; 280/607; 280/629

[58] Field of Search ..... 280/613, 617, 280/618, 620, 628, 629, 634, 636

[56] References Cited

U.S. PATENT DOCUMENTS

| | | | |
|---|---|---|---|
| 4,538,828 | 9/1985 | Dimier | 280/628 |
| 4,561,673 | 12/1985 | Pascal et al. | 280/629 |
| 4,984,816 | 1/1991 | Rullier | 280/625 |
| 5,040,821 | 8/1991 | Berthet et al. | 280/625 |
| 5,044,658 | 9/1991 | Challande et al. | 280/631 |
| 5,215,326 | 6/1993 | Baron et al. | 280/636 |
| 5,303,950 | 4/1994 | Rigal et al. | 280/636 |
| 5,344,180 | 9/1994 | Lancon et al. | 280/625 |
| 5,558,356 | 9/1996 | Challande et al. | 280/625 |
| 5,560,634 | 10/1996 | Challande et al. | 280/634 |
| 5,566,968 | 10/1996 | Challande et al. | 280/634 |

FOREIGN PATENT DOCUMENTS

| | | | |
|---|---|---|---|
| 0580996 | 2/1994 | European Pat. Off. . | |
| 2640516 | 6/1990 | France . | |
| 2656225 | 6/1991 | France . | |
| 2707513 | 1/1995 | France . | |
| 27 56 897 | 8/1978 | Germany | 280/628 |
| 2905837 | 8/1980 | Germany . | |
| 3335878 | 4/1984 | Germany . | |
| 3343545 | 5/1984 | Germany . | |
| 3840949 | 6/1989 | Germany . | |
| WO91/08808 | 6/1991 | WIPO . | |
| WO91/09654 | 7/1991 | WIPO . | |

*Primary Examiner*—Brian L. Johnson
*Assistant Examiner*—Bridget Avery
*Attorney, Agent, or Firm*—Greenblum & Bernstein, P.L.C.

[57] ABSTRACT

A retention element of a boot on a gliding board, particularly an alpine ski including a body, a base, a jaw for retaining the boot, likewise including a compensation mechanism to lower the return force that the spring exerts on the jaw. The support plate is movable to rock laterally around a longitudinal rocking axis, the support plate being supported on each side of the rocking axis on movable linkage assembly with the compensation mechanism, the rocking axis of the plate being movable along a vertical direction over a limited amplitude, and an elastic return device elastically returns the plate to the raised position.

16 Claims, 4 Drawing Sheets

ALPINE SKI BINDING APPARATUS

BACKGROUND OF THE INVENTION

1. Field of the Invention

The present invention relates to an alpine ski binding element, adapted to retain a boot supported on a ski, and to free it in case of excessive force being exerted upon it.

2. Description of Background and Material Information

It is known to retain a shoe supported on a ski by means of front and rear binding elements. These elements have as a main function to retain the boot on the ski, in the fashion so as to allow the skier to guide his or her ski, in particular by forces which are transmitted to the boot as a function of the path desired to be followed and reaction forces that are transmitted to the skier. Another function of these binding elements is to release this retention of the boot, i.e., to free the boot when the forces between the boot and the ski become excessive to the point of causing injury of the leg of the skier. But it is difficult to discern at which moment a force really becomes dangerous to the leg of the skier. On the other hand, freeing the boot when it is not necessary constitutes what is commonly referred to as a premature release.

Each retention element normally has a jaw carried by a body which is movable against the return force exerted by an energy spring, generally a compression spring.

The invention relates more particularly to a front binding element. Normally, the front binding element reacts to a lateral force of the front end of the boot. Such a bias results from a pure torsional force on the leg of the skier.

Certain binding elements have a compensation mechanism which reacts in case of torsional force combined with a frontward fall of the skier. Such a mechanism is described for example in published German patent application No. 29 05 837. This mechanism comprises a support plate of the boot which is vertically movable, whose movement caused by a vertical downward pressure of the boot lowers the return force that the spring exerts on the jaw.

Another mechanism is described in published German patent application No. 33 35 878. This mechanism also comprises a support plate of the boot which is vertically movable and which forces the jaw to displace in the direction of freeing the boot. Such apparatuses compensate for the increase of friction by the boot on its supports that the frontward component of the fall induces. Such mechanisms are satisfactory as long as the lateral component of the fall remains preponderant with respect to the vertical component.

The binding elements which are presently in existence have further an apparatus making it possible to adapt this element to different thicknesses of boot soles. Generally one adapts a range of adjustment on the order of two millimeters which corresponds to the tolerance of thickness of a boot sole according to standard DIN 7880.

Certain binding elements automatically achieve this height adjustment. Among them is further known according to published European patent application No. 580 996, a binding element which has a compensation mechanism of the type previously described, whose support pedal is raised at rest with respect to the lever which activates the compensation mechanism. Upon engagement of the boot, the support pedal lowers until it enters into contact with the compensation lever. This achieves the automatic adaptation of the binding element to the shoe thickness. From this position, the support plate can exert an action on the compensation mechanism. The two phases of operation of the support plate are linked together along the same rotational movement of the plate around a substantially transverse axis.

This binding element has an advantage that the support pedal of the boot both assures the adaptation function to the thickness of the sole, and control of the compensation mechanism.

SUMMARY OF THE INVENTION

One of the aims of the invention is to further improve this type of binding element by allowing for an easier release of the boot, in particular during certain types of falls.

It has indeed been noted that in the case of certain "front torsional falls", i.e. falls having a frontward component and a lateral component, the lateral component is not sufficient to cause the lateral rocking of the jaw. One observes then a twisting of the boot which is stuck between the jaw and its support plate. The compensation mechanisms presently known are not sufficiently active to facilitate the opening of the jaw. It happens that these falls become dangerous, and cause injury in particular in the area of the knees of the skier.

Another aim of the invention is to provide a binding element whose construction is simple.

According to the invention, the retention element of a boot on a gliding board, particularly an alpine ski, comprises a body provided to be connected to the ski by means of a base. The body carries a retention jaw of the boot, the jaw being movable at least in part and at least along a lateral direction in response to the forces of the boot, against the return force of a spring housed in the body. The element comprises a compensation mechanism to lower the return force that the spring exerts on the jaw in response to a force exerted on a lever journalled with respect to the body or the base, and it furthermore has a support plate provided to receive the sole of the boot.

The support plate is movable to rock laterally around an axis which is oriented substantially in a vertical and longitudinal plane, and the support plate rests on each side of the rocking axis on movable linkage assembly whose front end rests in simple support on the compensation mechanism. The rocking axis of the plate is movable along a vertical direction over a limited amplitude, and an elastic return device elastically biases the plate in the raised position.

The act of rendering the support plate movable around a longitudinal rocking axis makes it possible to activate the compensation mechanism during twisting of the boot. It is thought that this allows for an easier release of the boot, in particular in the case of a front-torsional fall. In effect, the compensation mechanism diminishes the force that the jaw opposes to the opening, and as a result compensates for the increase of friction caused by the twisting of the boot.

The fact that the rocking axis of the support plate is made movable along a vertical direction makes it possible to assure the function of adapting to the thickness of the sole of the boot, while the movements of the support plate for its compensation function and this adaptation function are of a distinct nature.

According to another characteristic of the invention, the support plate is returned to the raised position by a spring which exerts its activity on the linkage assembly connecting the support plate and the compensation mechanism. Thus, the support plate is maintained in the horizontal position, without play, by a linkage assembly, in particular in the absence of a boot.

BRIEF DESCRIPTION OF THE DRAWINGS

The invention will be better understood with reference to the description below and the annexed drawings which are an integral portion of this application.

DETAILED DESCRIPTION

Figure 1:
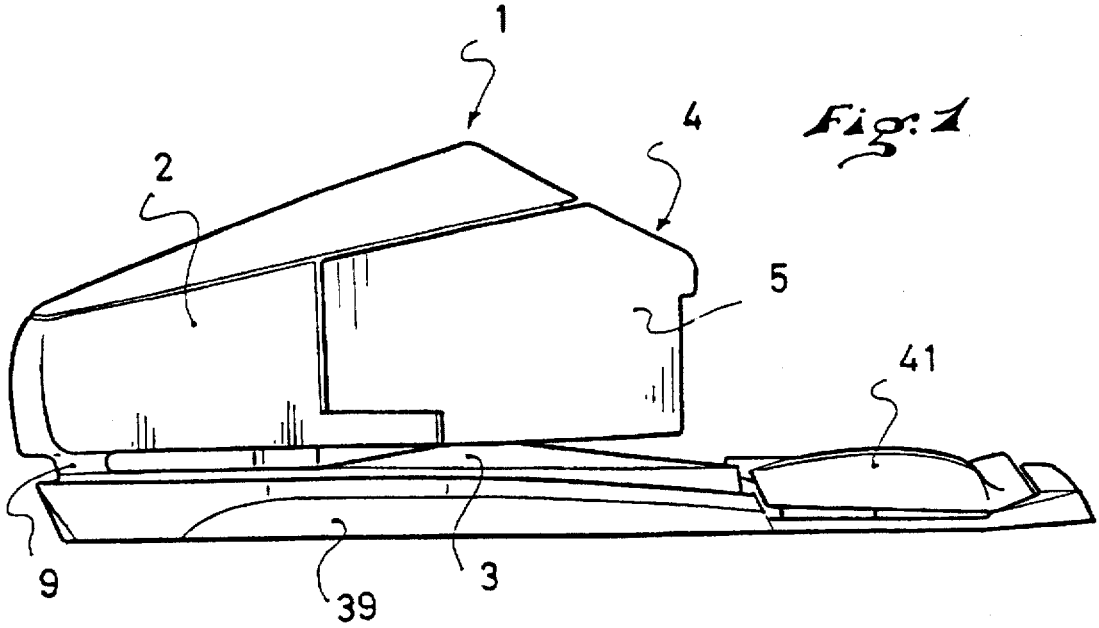
FIG. 1 is a general side view, in partial cross section, of a binding element according to one non-limiting embodiment of the invention.
Figure 2:
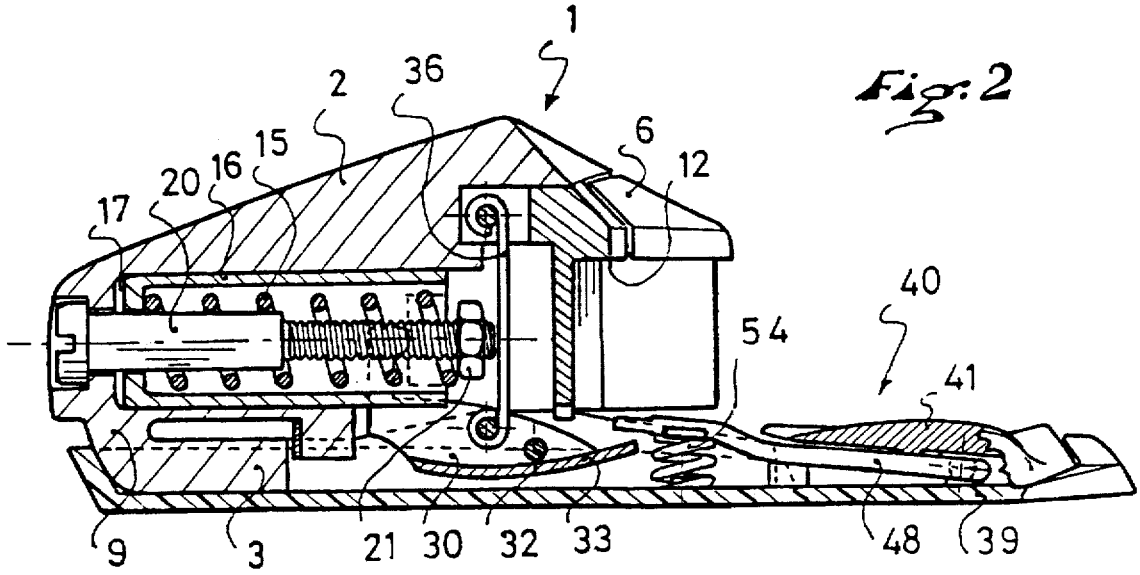
FIG. 2 is a side view, in partial cross section of the binding element of FIG. 1.
Figure 3:
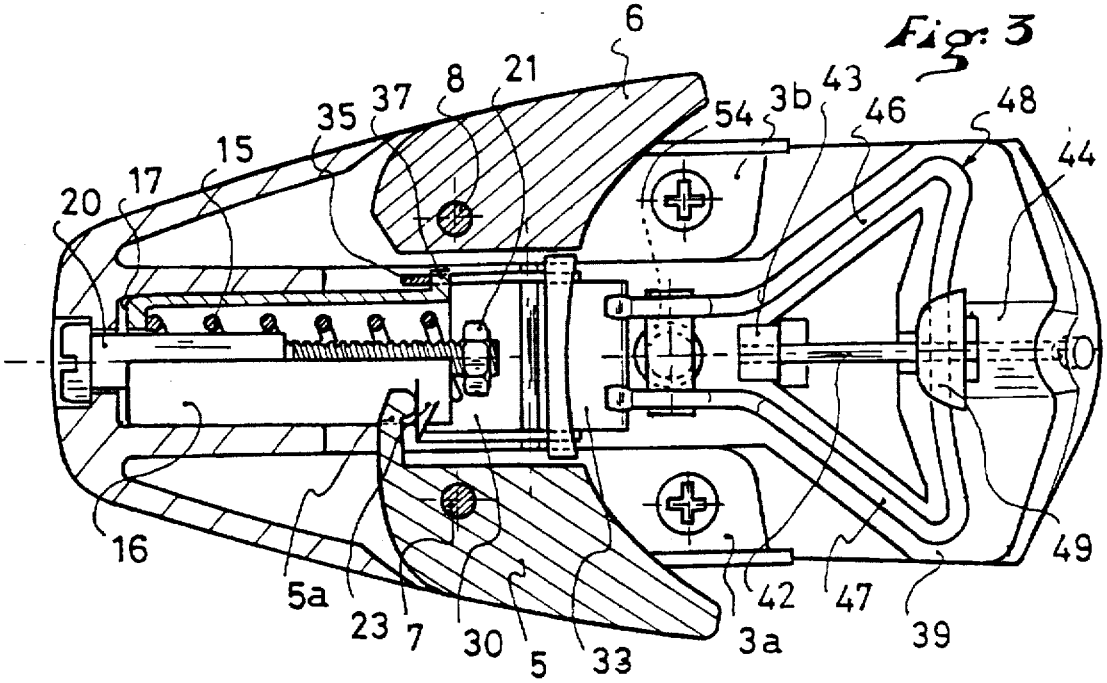
FIG. 3 illustrates two half-views of the top of the binding element of FIG. 1 with different cross sectional planes.
Figure 4:
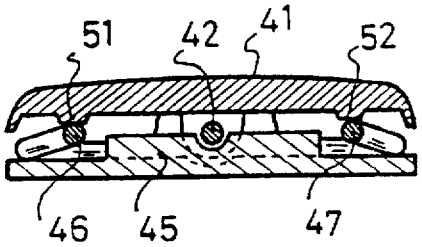
FIG. 4 is a transverse cross sectional view of the element of FIG. 1 at the level of the support apparatus of the boot.
Figure 5:
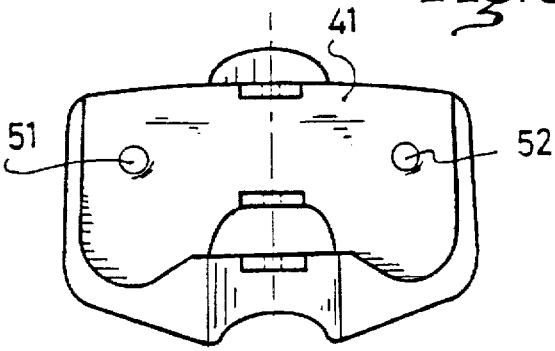
FIG. 5 is a bottom view of the support plate.

The front binding element 1 shown in FIGS. 1–3 is essentially known from published French patent publication No. 2 640 516.

It comprises a body 2 connected to a base 3 which is solidly affixed to the ski by any appropriate means and for example by screws. Seen, on top, the base has a "U" shape which is open towards the rear, with two lateral arms 3*a* and 3*b*.

The body is vertically movable with respect to the base by a deformable linkage, which is localized in zone 9 at the junction between the body and the base. The body and the base are connected continuously by this deformable zone and form a monoblock element.

Body 2 carries a front end retention jaw 4 of the boot. Jaw 4 comprises two lateral retention wings 5 and 6, respectively journalled to body 2 around axes 7 and 8. Jaw 4 comprises also a sole grip 12 for vertical retention of the boot.

Wings 5 and 6 are movable in response to the forces of the boot, against the return force applied to them by spring 15.

Spring 15 is housed in the body. It activates a piston 16 which is likewise housed and guided in the body for a longitudinal translational movement. The figures illustrate that the piston is housed and guided in a housing 17 of the body, and that the spring is engaged within the piston. Its front end is supported against the end of the piston, situated on the front side of the binding element. A screw 20 whose head is retained at the front of the body furthermore traverses the piston and the spring, and has towards the rear a nut 21 which retains the rear end of the spring. A rotation of the screw drives the spring in translation, which makes it possible to adjust the initial compression of the spring.

Wings 5 and 6 have beyond their journal axes 7 and 8 a small arm 5*a* and 6*a* which drives the piston 16 towards the rear by taking support against a shoulder 23 positioned in the rear upper portion of piston 16.

Element 1 furthermore has a compensation mechanism which lightens the return force that spring 15 exerts on the wings 5 and 6.

This mechanism comprises a rocker or pivotal element 30 which is housed in part between arms 3*a* and 3*b* of base 3. The rocker is journalled around an axis 32 of a pin or axle carried by these arms.

Rocker 30 has an approximately horizontal arm 33 which is accessible over the rear of the binding element between arms 3*a* and 3*b* of the base. The arm 33 offers towards the rear a support for a control pedal. This pedal will be described in greater detail below.

Rocker 30 furthermore has an approximately vertical arm formed by two lateral flaps which extend on each side of piston 16, and which each carry on a shoulder 37 that the piston has under shoulder 23 of the wings. Only flap 35 is visible in the figures.

In the embodiment illustrated in the figures, the compensation mechanism furthermore has a linkage shaft 36 which connects rocker 30 to the rear portion of the body 2. The journal of shaft 36 to rocker 30 is situated in front of axis 32. The shaft transmits to rocker 30, and thus to piston 16, the elevational movements of the body which occur particularly during a vertical force of the boot in the jaw.

The construction of the binding element which has just been described is of course not limiting. Other constructions may be appropriate, as along as they have or can receive a compensation mechanism. Such constructions are for example described in published German patent application Nos. 38 40 949 and 33 43 545. Other constructions may also be appropriate.

The binding element 1 furthermore comprises a support apparatus 40 for the front end of the sole of the boot.

The support apparatus has a support plate 41 on which the sole of the boot rests. Plate 41 can be equipped at its rear portion with any appropriate lining adapted to facilitate the lateral sliding of the boot, for example a polytetrafluorethylene plate. It has a width which is on the order of the width of the ski at this level. In the embodiment shown, plate 41 is carried by a pin or axle 42 oriented along a longitudinal and approximately horizontal direction. Plate 41 can rock around the axis of pin 42 on one side or the other.

Pin 42 is mounted in a bearing formed by supports 43 and 44, affixed to a socket 39 which is solidly connected to base 3. The socket extends base 3 towards the rear. Any other appropriate arrangement may also be appropriate, and for example, the socket could form a monoblock assembly with the base.

The pin supports 43 and 44 which carry pin 42 allow for a movement of the plate 41, over a limited amplitude, in a longitudinal and vertical plane. For example, as is shown, the front pin support 43 has for pin 42 an oblong orifice 45 whose major dimension is directed vertically. The front support 44 retains the other end of axis 42 without vertical movement, but it is provided to allow for the movement of pin 42 in the oblong hole 45 of the support 43.

A linkage assembly further connects plate 41 to rocker 30. This assembly transmits the rocking movement of the plate around axis 42 in the form of a vertical force exerted downwardly on arm 33 of rocker 30.

In the embodiment shown in the figures, the linkage assembly comprises a wire or rod 48 bent along an approximately "U" shape whose arms 46 and 47 pass under plate 41, on both sides of axis 42, and converge towards rocker 30. In its rear portion, the rod 48 is maintained in a housing formed by a flap 49 affixed to socket 39. The arms of the shaft can oscillate around the zone defined by this housing. Preferably, shaft 48 has a flattened zone at its middle. This zone facilitates the positioning and circulation of pin 42.

Advantageously, rod 48 is formed out of spring steel, or out of a material having a certain elasticity. This improves the transmission to the rocker 30 of the rocking movement of plate 41.

Plate 41 has at its lower surface, on each side of axis 42, a support zone for each of arms 46 and 47. Preferably, this support zone is formed by a abutments 51 and 52, which project downwardly. In this manner, the contact zone is localized with precision, even during rocking movements of the plate.

Towards the front, arms 46 and 47 of the rod 48 are provided to rest freely in abutting contact atop arm 33 of rocker 30, at the rear of axis 32, along a downward vertical direction to provide a structural transmission for movement of the support plate.

A spring 54 furthermore upwardly biases the front end of arms 46 and 47. In the embodiment shown, spring 54 is a compression spring arranged between socket 45 and the front end of arms 46 and 47.

Preferably, spring 54 is relatively rigid, and it is provided to lift the front end of arms 46 and 47 substantially above arm 33 of the rocker.

In summary, plate 41 is movable around axis 42. The plate and axis are vertically movable along a trajectory and an amplitude defined principally by the oblong orifice 45. The plate is furthermore supported by abutments 51 and 52 on arms 46 and 47 which assure the linkage with rocker 30 of the compensation mechanism, and the arms are movable downwardly against the return force which is opposed by a spring 54.

Spring 54 pushes arms 46 and 47 upwardly. These arms, in turn, drive plate 41 and its journal axis 42 upwardly. It is the oblong orifice 45 which limits the upward movement of the plate and arms. The dimensions and the positions of this orifice are provided such that, at rest, the front end of the arms is lifted above the rocker at a distance corresponding substantially to the thickness tolerance that the soles of the ski boot have, on the order of two millimeters. However, this value is in no way limiting.

The dimensions and the position of orifice 45 are furthermore provided such that the end of axis 42 reaches the lower end of the oblong orifice 45 when the front end of the arms 46 and 47 arrive into contact with arm 33 of the rocker.

Figure 6:
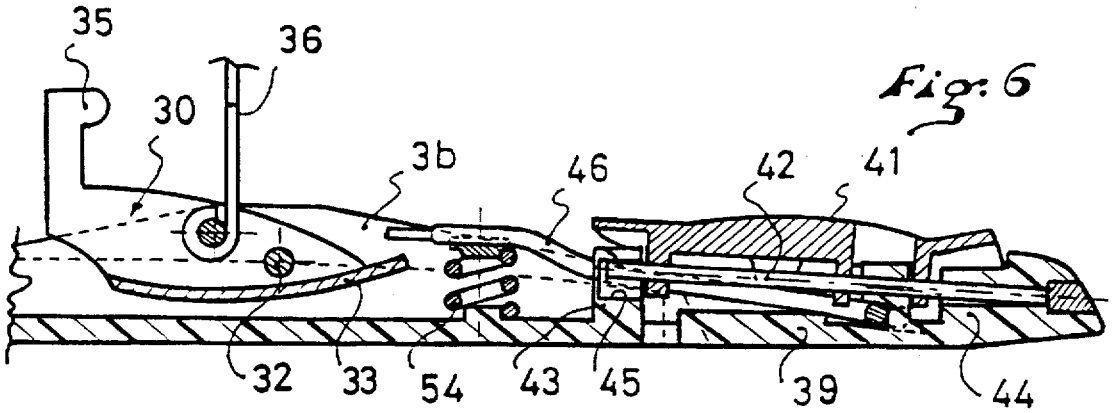
FIG. 6 is a side view in longitudinal cross section of the support apparatus of the boot.

The operation of the support apparatus is as follows. In the absence of the boot, spring 54 pushes arms 46 and 47 upwardly, as well as plate 41 and axis 42. The front end of the arms is lifted well above the horizontal arm 33 of the rocker. The plate is biased upwardly by the arms, but retained by its axis 42 within housing 45. As a result, it is maintained without play in a horizontal seat. This position is illustrated in FIG. 6.

When the boot is engaged, the support plate is lowered until the front end of arms 46 and 47 is supported on arm 33 of rocker 30. Spring 54 opposes an elastic resistance to this movement. During this entire phase of movement, the support plate remains substantially horizontal, and the front end of the plate describes the oblong orifice 45 along a vertical direction. Preferably, pin 42 rests on the lower end of orifice 45 when the arms 46 and 47 are supported on rocker 30. This phase of operation is illustrated in FIG. 7.

Figure 7:
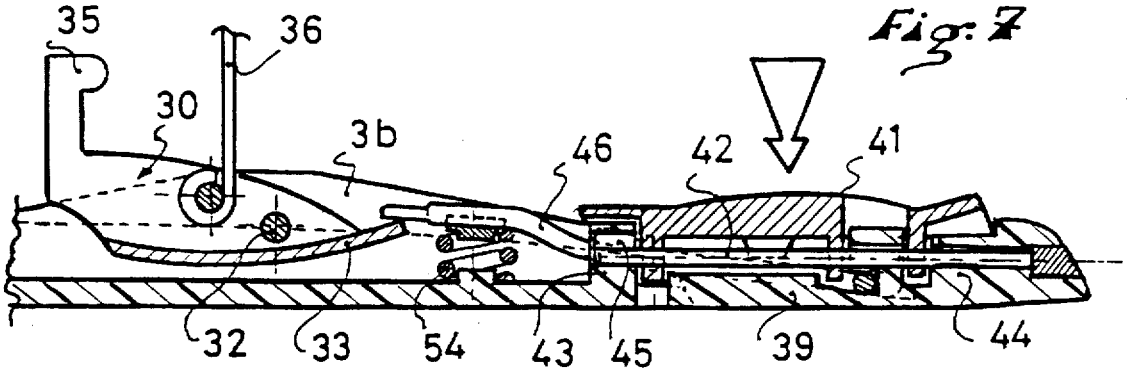
FIGS. 7 and 8 illustrate the different phases of operation of the apparatus of FIG. 6.
Figure 8:
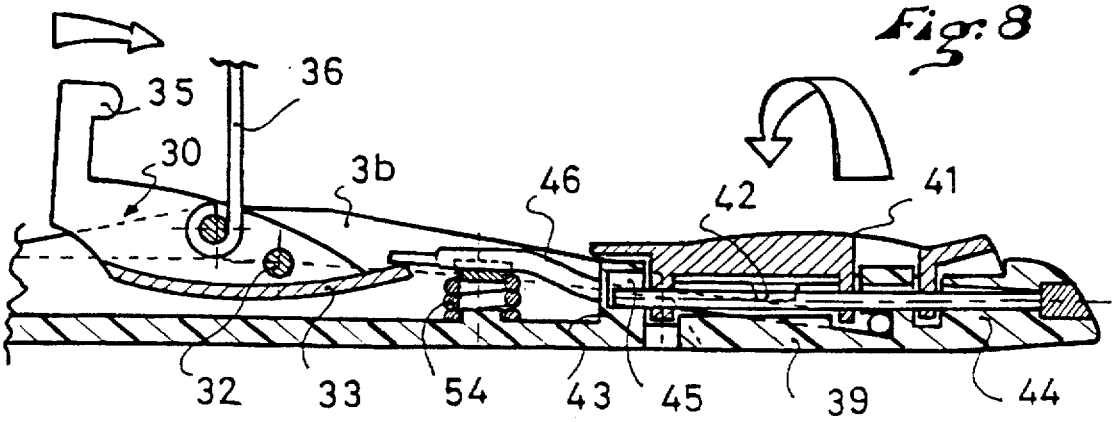

From the position shown in FIG. 7, the plate can no longer be displaced downwardly except by rocking around the axis of pin 42, in response to lateral rocking forces that the front of the boot exerts on the plate. The rocking of the plate 41 around the axis of pin 42 causes the lowering of one or the other of the arms 46 or 47. The biased arm transmits its force to arm 33 of rocker 30 which pivots in the direction of compensation, i.e., in the direction corresponding to a retraction of the piston and a compression of the spring 15. This phase of operation is illustrated in FIG. 8.

When the rocking bias ceases, the plate is brought back to the horizontal position by arms 46 and 47, as a result of the impulse of rocker 30 and of spring 54.

When the boot is disengaged from the binding element, spring 54 returns the plate and arms 46 and 47 upwardly, i.e., above the arm 33 of rocker 30. The plate is maintained without play in the horizontal position by arms 46 and 47, given that it is furthermore retained by pin 42. One thus avoids any wobbling which can occur during manipulation of the binding element. Such a wobbling would cause a premature wear of the support apparatus. It would destroy the confidence that a non-expert user could feel with respect to such a binding element.

The invention is not limited to the construction which has just been described. In particular, the linkage assembly could be of another type. The wire or rod 48 which is configured by bending could be replaced by a plate journalled at its rear portion in the zone of flap 49 and bored in its central portion for the passage of the pin 42. The support plate 41 would then be supported against this plate on each side of pin 42.

Figure 9:
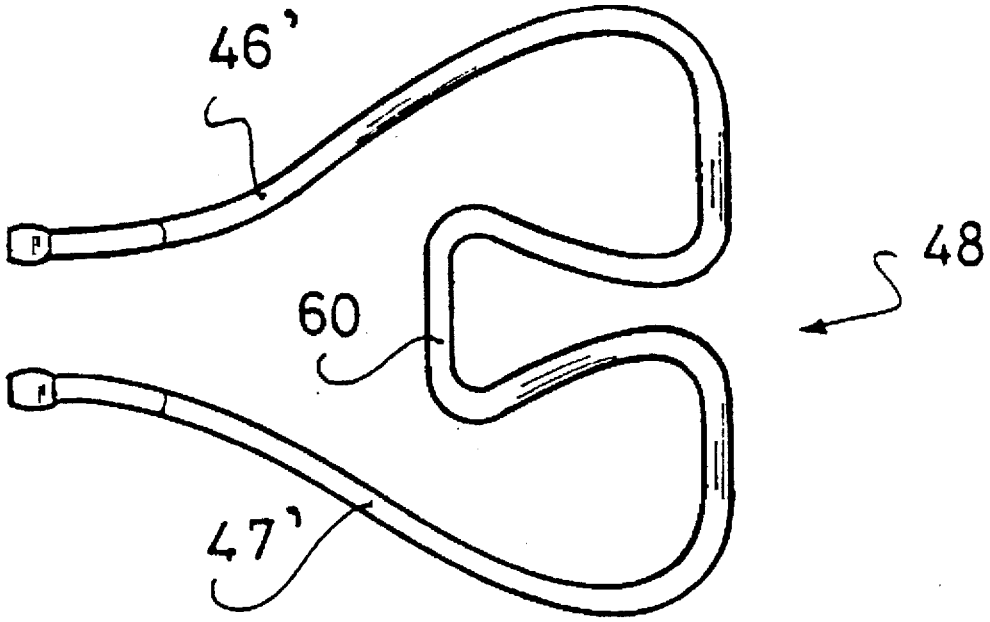
FIGS. 9 and 10 relate to an alternative embodiment.
Figure 10:
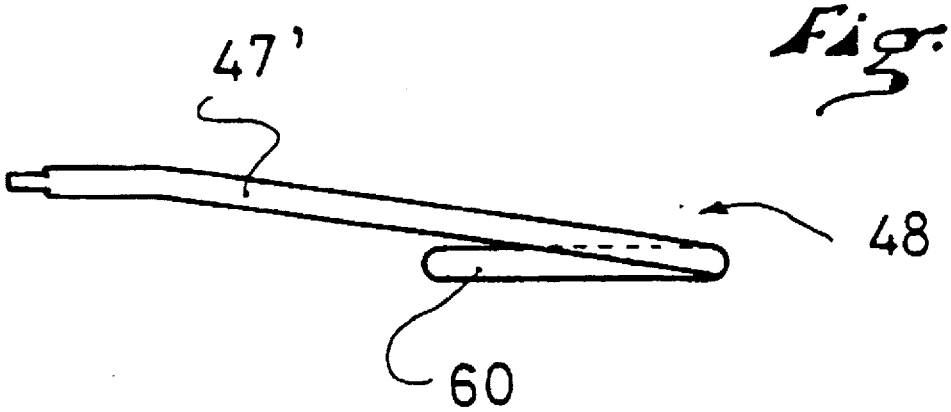

Furthermore, spring 54 could be replaced by another elastic return element, for example a torsional spring which would act on the arms 46 and 47. As shown in FIGS. 9 and 10, the spring could also be formed by a central buckle of the rod 48'. In place of a "U" shape, the rod 48' would indeed have a "W" shape whose central buckle 60 would form an angle with the lateral arms. This central buckle would be supported against socket 45, and the return energy would then result from the torsion of the line. As in the preceding case, the ends of arms 46' and 47' would be situated directly beneath arm 33 of rocker 30. If necessary, the middle of the central buckle 60 could have a flattened portion to facilitate the rotation of pin 42.

Journal pin 42 of plate 41 may also be slightly offset in position or in orientation with respect to the longitudinal median direction defined by the ski, in a manner so as to create a slight dissymetry in the action of the compensation means. In this case, the binding element of the other foot would have a symmetrical offset.

The instant application is based upon French patent application No. 94.08940 filed Jul. 13, 1994, the priority of which is claimed under 35 U.S.C. §1.119, the disclosure of which is hereby expressly incorporated by reference thereto.

Finally, although the invention has been described with respect to particular means, materials and embodiments, it is to be understood that the invention is not limited to the particulars disclosed and extends to all equivalents within the scope of the claims.

What is claimed is:

1. A binding apparatus for retaining a boot upon an alpine ski, said apparatus comprising:

a base adapted to be affixed to the ski;

a body mounted upon said base;

a retention jaw borne by said body adapted to engage the boot, said retention jaw being mounted for a boot-releasing movement with respect to said base in response to forces exerted via the boot;

a spring housed in said body, said spring being mounted to exert an elastic return force in opposition to said boot-releasing movement of said jaw;

a support plate adapted to support at least a portion of a sole of the boot in a nominal position of said support plate, and a movement support structure mounting said support plate for rocking movement about a rocking axis, said rocking axis extending in a substantially longitudinal vertical plane, and for a vertical component of movement of said rocking axis within said substantially longitudinal vertical plane over a predetermined amplitude, said movement support structure comprising a linkage assembly providing a structural transmission for movements of said support plate;

a compensation mechanism connecting said spring and said linkage assembly, said compensation mechanism lowering said elastic return force of said spring in response to a predetermined movement of said linkage assembly, said compensation mechanism comprising a pivot element, said linkage assembly having a front end in abutting contact atop said pivot element; and an elastic return element mounted to exert an elastic return force to said support plate to move said support plate within said substantially longitudinal vertical plane to a position having said front end of said linkage assembly raised with respect to said pivot element.

2. A binding apparatus according to claim 1, wherein:

said elastic return element is positioned to exert an upwardly directed return force on said linkage assembly, said force thereby transmitting said upwardly directed return force to said support plate.

3. A binding apparatus according to claim 2, wherein:

said elastic return element is mounted to exert said elastic return force to said front end of said linkage assembly to said position whereby said front end of said linkage assembly is spaced substantially above said position whereby said front end of said linkage assembly is in said abutting contact atop said pivot element.

4. A binding apparatus according to claim 2, wherein:

said movement support structure of said support plate comprises:

a journal pin extending along said rocking axis; and an elongated guide, said journal pin having an end movable within said elongated guide to guide said pin for movement within said substantially longitudinal vertical plane.

5. A binding apparatus according to claim 3, wherein:

said movement support structure of said support plate comprises:

a journal pin extending along said rocking axis; and an elongated guide, said journal pin having an end movable within said elongated guide to guide said pin for movement within said substantially longitudinal vertical plane.

6. A binding apparatus according to claim 4, wherein:

said elongated guide includes an upper end, said journal pin abutting said upper end to limit upward movement of said support plate under the impulse of said elastic return element.

7. A binding apparatus according to claim 5, wherein:

said elongated guide includes an upper end, said journal pin abutting said upper end to limit upward movement of said support plate under the impulse of said elastic return element.

8. A binding apparatus according to claim 1, wherein:

said linkage assembly comprises arms formed by a rod bent in a substantially U-shape, said arms extending beneath said support plate on either lateral side of said rocking axis and converging toward said compensation mechanism.

9. A binding apparatus according to claim 1, wherein:

said retention jaw has a shape adapted to engage a front end of the boot and said support plate is adapted to support a sole portion of the front end of the boot.

10. A binding apparatus according to claim 1, wherein:

said body and said movement support structure for said support plate are mounted upon said base.

11. A binding apparatus according to claim 1, wherein:

said movement support structure comprises a pivot pin extending along said rocking axis defining said rocking movement.

12. A binding apparatus for retaining a boot upon a gliding board, said apparatus comprising:

a base adapted to be affixed to the gliding board;

a body mounted upon said base;

a retention jaw borne by said body adapted to engage the boot, said retention jaw being mounted for a boot-releasing movement with respect to said base in response to forces exerted via the boot;

a spring housed in said body, said spring being mounted to exert an elastic return force in opposition to said boot-releasing movement of said jaw;

a support plate adapted to support at least a portion of a sole of the boot in a nominal position of said support plate; and means for supporting said support plate for sequential movement from said nominal position:

(A) to a position vertically lower along a substantially longitudinal vertical plane; and (B) about a rocking axis extending substantially in said longitudinal vertical plane to a release position.

13. A binding apparatus according to claim 12, further comprising:

a linkage assembly connected to said support plate;

a compensation mechanism connecting said spring and said linkage assembly, said compensation mechanism lowering said elastic return force of said spring in response to a predetermined movement of said linkage assembly, said compensation mechanism comprising a pivot element, said linkage assembly having a front end in abutting contact atop said pivot element; and an elastic return element mounted to exert an elastic return force to said support plate to move said support plate within said substantially longitudinal vertical plane to a position having said front end of said linkage assembly raised with respect to said pivot element.

14. A binding apparatus according to claim 12, wherein:

said means comprises means for supporting said support plate for movement along a substantially longitudinal vertical plane in response to the boot becoming engaged in said retention jaw to assume said nominal position; and said means comprises means for supporting said support plate for movement about a rocking axis in response to a release force exerted by the boot to move said support plate to said release position.

15. A binding apparatus according to claim 12, wherein:

said retention jaw has a shape adapted to engage a front end of the boot and said support plate is adapted to support a sole portion of the front end of the boot.

16. A binding apparatus according to claim 12, wherein:

said body and said means are mounted upon said base.

* * * * *